United States Patent [19]

Geremia

[11] Patent Number: 4,482,792

[45] Date of Patent: Nov. 13, 1984

[54] SEALED TOGGLE SWITCH

[75] Inventor: Leo Geremia, Wallingford, Conn.

[73] Assignee: Tri-tech, Inc., Waterbury, Conn.

[21] Appl. No.: 327,804

[22] Filed: Dec. 7, 1981

[51] Int. Cl.[3] ..... H01H 21/08

[52] U.S. Cl. ..... 200/302.3; 200/284

[58] Field of Search ..... 200/302, 153 G, 284, 200/339, 67 G; 411/500, 501; D8/386

[56] References Cited

U.S. PATENT DOCUMENTS

| | | | |
|---|---|---|---|
| 2,120,530 | 6/1938 | Shippee et al. | 411/500 X |
| 2,248,362 | 7/1941 | Krieger | 200/67 G |
| 2,749,400 | 6/1956 | Chichester | 200/153 G |
| 2,785,259 | 3/1957 | Haydon | 200/302 |
| 2,842,644 | 7/1958 | Korsgren, Sr. | 200/302 |
| 2,861,156 | 11/1958 | Kulka | 200/302 |
| 2,977,447 | 3/1961 | Korsgren, Sr. et al. | 200/153 T |
| 3,035,134 | 5/1962 | Hults | 200/302 X |
| 3,047,682 | 7/1962 | Hults | 200/339 X |
| 3,057,223 | 10/1962 | Korsgren, Sr. | 74/491 |
| 3,225,153 | 12/1965 | Carling | 200/67 G |
| 3,562,700 | 2/1971 | Miller | 200/284 X |
| 3,614,702 | 10/1971 | Vargas | 200/284 X |
| 3,641,291 | 2/1972 | Carling | 200/335 X |
| 3,789,176 | 1/1974 | Pick | 200/302 |
| 3,819,891 | 6/1974 | Miller et al. | 200/302 X |
| 3,944,774 | 3/1976 | Noba et al. | 200/302 |
| 3,989,915 | 11/1976 | Nishikawa | 200/153 G X |
| 4,191,387 | 3/1980 | Kirchoff | 200/302 X |

FOREIGN PATENT DOCUMENTS

| | | | |
|---|---|---|---|
| 645523 | 9/1962 | Italy | 200/68 A |

OTHER PUBLICATIONS

Catalog from *Chicago Rivet and Machine Co.*-pp. 22 and 28-Apr., 1965.

*Primary Examiner*—John W. Shepperd
*Assistant Examiner*—Renee S. Kidorf
*Attorney, Agent, or Firm*—Lee C. Robinson, Jr.

[57] ABSTRACT

A sealed toggle switch is formed of a hollow thermosetting plastic base, a metal cover closing off the base, a rocking blade, and a bat actuator handle having a ball disposed to rotate in a socket bushing in the cover and a resiliently biased finger pushing against the blade to rock it from one position to another when the bat actuator is moved. Sealing is accomplished by an O-ring seated in a groove on an upper surface of the base and extending around the periphery of the same. This O-ring is compressed by the cover to form a seal. Another O-ring is seated in an annular groove in the bushing and is compressed against the ball of the actuator handle. Contacts of the switch are selectively connectable by rocking of the blade, and these extend through the base. Seals, such as O-rings or flat rubber seals, are provided between these contacts and the base. The toggle switch of this invention can favorably be constructed as a single-pole, double-throw two-position switch or a single-pole, double-throw, center-off three-position switch.

4 Claims, 3 Drawing Figures

FIG. 1
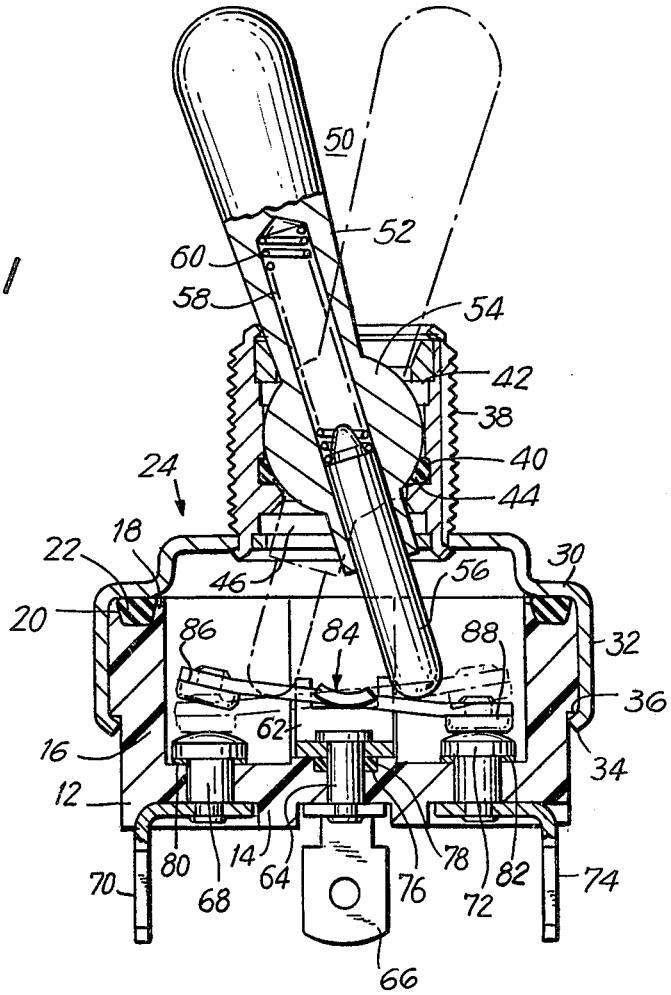
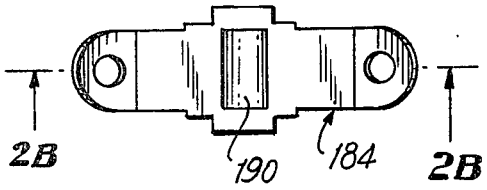
FIG. 2A
FIG. 2B
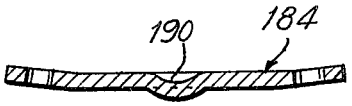

SEALED TOGGLE SWITCH

BACKGROUND OF THE INVENTION

1. Field of the Invention

The present invention relates to sealed switch assemblies, and is more particularly directed to an improved low-cost toggle switch that is reasonably well sealed from the atmosphere.

2. Brief Description of the Prior Art

Many uses exist, such as in factory, automotive, or marine environments, for a low-cost switch. However, in such environments, the switch should be sufficiently well sealed so that corrosives, dust, and other impurities in the atmosphere will not impair operation of the switch or shorten its useful life.

Available sealed switches tend to be extremely expensive, notably because of the labor-intensive manufacturing methods necessary to construct them. Sealed switches usually involve glass seals, and have covers which are brazed or soldered.

On the other hand, available low-cost toggle switches normally have a base, or body of thermosetting plastic resin. Although such switches can be easily mass produced, and thereby produced quite cheaply, it has not previously been possible to provide these switches with atmospheric seals. As it is apparent, switches made from thermosetting resins cannot be brazed, nor can glass sealing compounds be used with such switches.

OBJECTS AND SUMMARY OF THE INVENTION

Accordingly, it is an object of this invention to provide a simple, low-cost toggle switch which is reasonably well sealed, and which thus avoids the aforementioned problems of the prior art.

In addition, it is an object of this invention to provide a toggle switch assembly which can be easily mass produced, and which is reasonably immune from dust or corrosives carried in the atmosphere.

According to several preferred emobodiments of this invention, a sealed switch assembly comprises a hollow base member of thermoplastic resin having a peripheral wall, a bottom, and a rim at an upper surface of the peripheral wall with a groove extending around the entire perimeter of the upper surface. An O-ring seal is seated in this groove, and a metal cover is disposed on the base member, with a portion of the cover mating with the upper surface of the base member compressibly held down against the O-ring seal. An electrical switch mechanism, which can include a rockably mounted blade and a set of contacts extending through the bottom of the base member, is disposed on the interior of the switch assembly. A manual actuator, such as a telescoping lever, extends from the exterior to the interior of the sealed switch, and has a ball disposed thereon. A bushing situated on the metal cover has a socket which mates with the ball to permit at least limited rotary motion of the ball in one direction, and has lower and upper openings to which the actuator extends to the interior and exterior. An annular groove in the socket extends around the lower opening, and an O-ring seal in the annular groove is compressed against the ball to form a seal.

In several preferred embodiments, the contacts include a conductive pivot contact having a post extending through the bottom of the base member, and at least one switching contact also having a post extending through the bottom. In such case, the bottom has an annular cut beneath the pivot contact, and an O-ring seal is compressed in such annular cut beneath the pivot contact, while a flat, resilient annular seal is disposed about the post of the electrical contact between the latter and the bottom.

In addition to the above, many other objects, features, and advantages of this invention will become better understood from the ensuing description, which is to be read in conjunction with the accompanying drawings.

BRIEF DESCRIPTION OF THE DRAWINGS

FIG. 1 is a sectional elevation of one embodiment of a toggle switch according to this invention.

FIGS. 2A and 2B are a plan view and a sectional view, respectively, of a portion of the toggle switch assembly of this invention according to an alternative embodiment thereof.

DETAILED DESCRIPTION OF A PREFERRED EMBODIMENT

With reference to the drawings, and initially to FIG. 1 thereof, a toggle switch assembly 10 according to this invention has a hollow base 12, which may be formed of a thermosetting plastic resin. This base 12 has a bottom 14, and a side wall 16 extending around the periphery of the base. A top surface 18 of the peripheral side wall 16 has a perimetric groove 20 therein. That is, the groove 20 extends all the way around at the top surface 18 of the wall 16. An O-ring seal, preferably formed of silicone rubber, is situated in the perimetric groove 20.

A cover 24, preferably formed of 10—10 cold-rolled steel plated with nickel or cadmium for rust protection, is positioned on the base 12. A planar surface 30 thereof mates with the upper surface 18 of the peripheral wall 16 and the O-ring 22 is compressed thereby to form a seal.

Tabs 32 extend downward from this surface 30 along the peripheral wall, and a hook portion 34 thereof is bent inwardly to engage a mating shoulder 36 formed on the exterior of the peripheral wall 16.

A generally cylindrical bushing or socket 38 is located on the central part of the cover 24. Annular cuts 40 and 42 are provided in lower and upper portions of the bushing 38, and an O-ring 44 is disposed in one of these annular cuts, in this case, in the lower cut 40. A longitudinal opening 46, shown here in section only, communicates the interior of the switch assembly 10 with the bushing 38.

A bat actuator 50 includes an elongated bat portion 52 and a ball 54 which fits into the socket or bushing 38 and is held against the O-ring 44 to form a seal. The ball, which should be formed of at least a portion of a sphere, allows the elongated portion 52 of the actuator 50 to move in at least one direction, as permitted by the opening 46.

A telescoping finger 56 slides within a cylindrical socket 58 within the actuator 50, and a helical compression spring 60 biases the finger 56 towards the bottom 14 of the switch assembly 10.

The electrical switching arrangement in this embodiment is of the seesaw, or rocking-blade type. A central pivot contact 62 has a post 64 extending through the bottom 14 and is fastened to an external center contact 66.

A switch contact-and-post element 68 extends through the bottom 14, and is connected to an external contact 70, while another switch contact-and-post element 72 also extends through the bottom 14 and is connected to an external contact 74.

An annular cutout 76 surrounds the post 64 of the central pivot contact, and another O-ring seal 78 is disposed within this cutout 76 around the post 64 and is held in compression by the central pivot contact 62.

Similarly, flat resilient seals 80 and 82 surround the post elements 68 and 72 and are held in compression against the bottom 14.

The terminal external contacts 66, 70, 74 are riveted by the respective posts 64, 68, 72. These posts each have a shank of relatively large diameter passing through the bottom 14 of the base 12, and a rivet end of lesser diameter passing through an opening in the respective external contact 66, 70, 74. The setback between the shank and the rivet end defines a shoulder for each post 64, 68, 72. A rolled or flattened rivet head formed on the end of each post secures the respective contact 66, 70, 74 directly against the shoulder, rather than against the bottom 14 of the switch assembly 10.

A rocking blade 84, preferably formed of nickel-plated brass, rocks on the central pivot contact 62, and has contact pads 86 and 88 at ends thereof for alternately contacting the switching contacts 68 and 72, respectively.

It should be appreciated that the switch assembly 10 of FIG. 1 constitutes a two-position switch, that is, a single-pole, double-throw switch. In this embodiment, the actuator 50 has two stable positions, namely, the position shown in solid lines, in which the contacts 72 and 88 are closed while the other contacts 68 and 86 are open, and another position (in ghost lines), generally a mirror-image thereof, in which the contacts 68 and 86 are closed while the contacts 72 and 88 are open.

FIGS. 2A and 2B illustrate an alternative blade 184 which can be substituted for the blade 84. If the blade 184 is used, the toggle switch becomes a three-position toggle switch (i.e., single-pole, double-throw, center-off). A central indentation 190 in the blade receives the finger 56 at a central stable position in which both contacts 86 and 88 are held away from their respective switching contacts 68 and 72.

While the actuator 50 of the above-described embodiment can be made of any suitable material, it is preferred that the bat portion 52 and the ball portion 54 be formed of brass, and that the telescoping finger 56 thereof be formed of an insulator, such as thermosetting plastic.

It is also preferred that the O-ring seals 22, 44, and 78, and the flat seals 80 and 82 all be formed of silicone rubber to achieve a good seal.

A toggle switch constructed as described above has been determined to have an air leakage rate of $10^{-4}$ cc/atm/sec, which is nearly as low as can be achieved with a hermetically sealed switch.

Further, it has also been determined that even if only the single O-ring seal 44 is used to seal the ball 54 and the bushing 38, the switch 10 will be satisfactorily environmentally sealed. However, if a still better seal is desired, an additional O-ring (not shown) can be disposed in the upper annular cut 42.

The teachings disclosed herein could also be favorably applied to other types of switches, such as a single-pole, single-throw switch, or a double-pole, double-throw switch.

It should be understood that the specific form of the switch herein illustrated and described is intended to be representative only, and many changes and modifications can be made therein without departing from the clear teaching of the disclosure and without departing from the scope and spirit of this invention, which is to be determined from the appended claims.

What is claimed is:

1. A sealed switch comprising a hollow base member of insulator material having a peripheral wall, a bottom, and a rim at an upper surface of said peripheral wall with a perimetric groove extending along said upper surface; an O-ring seal disposed in said groove; a metal cover disposed on said base member to define an interior and an exterior of the switch and having a portion mating with said upper surface compressively against said O-ring seal; electrical switching means disposed in said interior and including a rockably mounted conductive blade disposed generally parallel to said bottom; a manual actuator having a metal lever handle extending from said exterior to said interior, with a telescoping non-conductive finger resiliently mounted to slide relative thereto and to contact said blade directly and bias it towards said bottom, said lever handle having a metal ball disposed thereon, the metal being of a type which forms a seal when compressively contacted by an O-ring seal of resilient material, a bushing disposed on said cover, having a socket to mate with said ball to permit at least limited rotary motion in at least the direction along said blade and having upper and lower openings leading to said exterior and said interior, respectively, with a first annular groove in said socket extending around said lower opening; an O-ring seal disposed in said annular groove compressively against said ball; means for holding said ball against said O-ring seal; wherein said electrical switching means includes a plurality of contact rivets extending through the base member; a like plurality of terminals secured by said contact rivets, said contact rivets each having a contact head, a shank passing through a cooperating aperture in said base member, a rivet end passing through an aperture in a respective one of said terminals, and a flattened head formed against the respective terminal securing the latter; and respective flat resilient sealing members compressed between the contact heads of said contact rivets and said bottom, with the portions of said bottom underlying said contact heads being substantially flush with adjacent portions of said bottom, so that said contact heads are held off the bottom by said sealing members, wherein said bottom is provided without recesses around said shanks of said contact rivets so that the sides of said flat sealing members facing said bottom are disposed flush with said bottom.

2. A sealed switch according to claim 1, wherein said contact rivets are shoulder rivets with said shank having a relatively larger outside diameter and said rivet end having a relatively smaller outside diameter, said shank and said rivet end meeting to define a shoulder, with said flattened head securing the associated terminal against the shoulder of the respective contact rivet.

3. A sealed switch according to claim 1, wherein said bushing also has a second annular groove extending about said upper opening for seating an additional O-ring seal for sealing against said metal ball.

4. A sealed switch according to claim 1, 2, or 3; wherein each said O-ring seal is formed of silicone rubber.

* * * * *